US010801300B2

(12) United States Patent
Saeed

(10) Patent No.: US 10,801,300 B2
(45) Date of Patent: Oct. 13, 2020

(54) COMPOSITE FRAC PLUG

(71) Applicant: Exacta-Frac Energy Services, Inc., Conroe, TX (US)

(72) Inventor: Ahmed Mohamed Saeed, Cypress, TX (US)

(73) Assignee: Exacta-Frac Energy Services, Inc., Conroe, TX (US)

( * ) Notice: Subject to any disclaimer, the term of this patent is extended or adjusted under 35 U.S.C. 154(b) by 198 days.

(21) Appl. No.: 15/935,163

(22) Filed: Mar. 26, 2018

(65) Prior Publication Data

US 2019/0292874 A1 Sep. 26, 2019

(51) Int. Cl.

| | |
|---|---|
| ***E21B 33/129*** | (2006.01) |
| ***E21B 33/128*** | (2006.01) |
| ***E21B 23/01*** | (2006.01) |
| *E21B 43/26* | (2006.01) |

(52) U.S. Cl.

CPC ..... *E21B 33/1293* (2013.01); *E21B 23/01* (2013.01); *E21B 33/128* (2013.01); *E21B 43/26* (2013.01)

(58) Field of Classification Search

CPC .... E21B 33/1293; E21B 23/01; E21B 33/128; E21B 43/26

See application file for complete search history.

(56) References Cited

U.S. PATENT DOCUMENTS

| | | | | |
|---|---|---|---|---|
| 5,984,007 | A * | 11/1999 | Yuan | E21B 33/1204 166/134 |
| 7,124,831 | B2 | 10/2006 | Turley et al. | |
| 8,047,279 | B2 | 11/2011 | Barlow et al. | |
| 8,113,276 | B2 | 2/2012 | Greenlee et al. | |
| 8,955,605 | B2 | 2/2015 | VanLue | |
| 8,997,853 | B2 | 4/2015 | VanLue | |
| 9,010,411 | B1 | 4/2015 | VanLue | |
| 9,074,439 | B2 | 6/2015 | VanLue | |
| 9,157,288 | B2 | 10/2015 | Martinez | |
| 9,316,086 | B2 | 4/2016 | VanLue | |
| 9,334,703 | B2 | 5/2016 | VanLue | |
| 9,416,617 | B2 | 8/2016 | Wiese et al. | |
| 9,631,453 | B2 | 4/2017 | VanLue | |
| 9,677,356 | B2 | 6/2017 | Rochen | |
| 9,689,228 | B2 | 6/2017 | VanLue | |
| 9,719,320 | B2 | 8/2017 | VanLue | |
| 9,725,981 | B2 | 8/2017 | Young et al. | |
| 9,725,982 | B2 | 8/2017 | VanLue | |
| 9,759,029 | B2 | 9/2017 | Davies et al. | |
| 2011/0079383 | A1* | 4/2011 | Porter | E21B 33/1208 166/118 |
| 2012/0097384 | A1 | 4/2012 | Valencia et al. | |

* cited by examiner

*Primary Examiner* — Yong-Suk Ro

(74) *Attorney, Agent, or Firm* — J. Bennett Mullinax, LLC

(57) ABSTRACT

A composite frac plug has an elastomeric gripper assembly in place of an up-hole set of slips. The elastomeric gripper assembly permits the composite frac plug to be shorter and lighter and more rapidly drilled out after fracking is completed.

20 Claims, 11 Drawing Sheets

COMPOSITE FRAC PLUG

FIELD OF THE INVENTION

This invention relates in general to frac plugs used for pressure isolation in cased wellbores during staged wellbore completion and, in particular, to a composite frac plug that is more quickly milled out of the cased wellbore after well stimulation is completed.

BACKGROUND OF THE INVENTION

Composite frac plugs are well known and widely used in staged wellbore completion of cased wellbores, commonly referred to as "plug and perf" completions. Long lateral wellbores are completed in stages (discrete sections) to ensure good fracture penetration in all areas of a production zone through which the wellbore has been drilled. The wellbore completion begins at a "toe" (farthest reach) of the wellbore and proceeds piecemeal in discrete, pressure isolated completion sections to the "heel" of the lateral wellbore, where the lateral wellbore joins a vertical bore of the hydrocarbon well. Each completed section is pressure isolated from a subsequent completion section using a composite frac plug to ensure that fracturing fluid does not flow into an already-fractured section of the wellbore. Those composite frac plugs are generally run into the well on a wireline and set with the wireline between each of the adjacent sections. In long lateral wellbores dozens of frac plugs may be set. Once fracturing is complete, the respective plugs are drilled out (cut up into small pieces that can be flushed out of the wellbore) using a special drill bit on a coil or jointed tubing string. Even though the plugs are constructed of composite materials, they must be very durable to withstand the extreme fluid pressures of fracking operations. Consequently, drilling the plugs out of the wellbore takes time, and appreciably reducing the time required for drilling out the plugs is highly desirable.

There therefore exists a need for a novel composite frac plug that is more quickly drilled out of a completed wellbore.

SUMMARY OF THE INVENTION

It is therefore an object of the invention to provide a novel composite frac plug that is shorter and lighter than known composite frac plugs, and therefore more quickly drilled out of a completed wellbore.

The invention therefore provides a composite frac plug comprising an elastomeric gripper assembly mounted to a composite mandrel having a central passage, the elastomeric gripper assembly having an insert groove in an outer periphery thereof with a plurality of circumferentially spaced-apart inserts in the insert groove that respectively bite and grip a casing of a cased wellbore when the composite frac plug is shifted from a run-in condition to a set condition.

The invention further provides a composite frac plug, comprising: a composite mandrel with a central passage, the composite mandrel further having an up-hole end and a downhole end with a mandrel hub on the up-hole end an end sub securely affixed to the downhole end; an elastomeric gripper assembly mounted to the mandrel, the elastomeric gripper assembly having an insert groove with a plurality of circumferentially spaced-apart inserts that bite and grip a casing of a cased wellbore when the composite frac plug is in a set condition; a main sealing element downhole of the elastomeric gripper assembly; a slip hub having a slip cone downhole of the main sealing element; and a slip assembly downhole of the slip hub, the slip assembly comprising a plurality of slips adapted to slide up the slip cone to bite and grip the casing of the cased wellbore when the composite frac plug is shifted from a run-in condition to the set condition.

The invention yet further provides a composite frac plug, comprising: a composite mandrel with a central passage, the composite mandrel further having an up-hole end and a downhole end, with a mandrel hub on the up-hole end and an end sub affixed to the downhole end; a gauge load ring adjacent the mandrel hub and affixed to the composite mandrel by gauge load ring preset retainer pins; an elastomeric gripper assembly mounted to the mandrel, the elastomeric gripper assembly having an insert groove with a plurality of circumferentially spaced-apart inserts that bite and grip a casing of a cased wellbore when the composite frac plug is in a set condition; a main sealing element downhole of the elastomeric gripper assembly that provides a high pressure seal with a casing of a cased well when the composite frac plug is in the set condition; a slip hub with a slip cone downhole of the main sealing element; and a slip assembly downhole of the slip hub, the slip assembly comprising a plurality of slips adapted to be pushed up the slip cone by the end sub and to bite and grip the casing of the cased wellbore when the composite frac plug is shifted from a run-in condition to the set condition.

BRIEF DESCRIPTION OF THE DRAWINGS

Having thus generally described the nature of the invention, reference will now be made to the accompanying drawings, in which.

Figure 1:
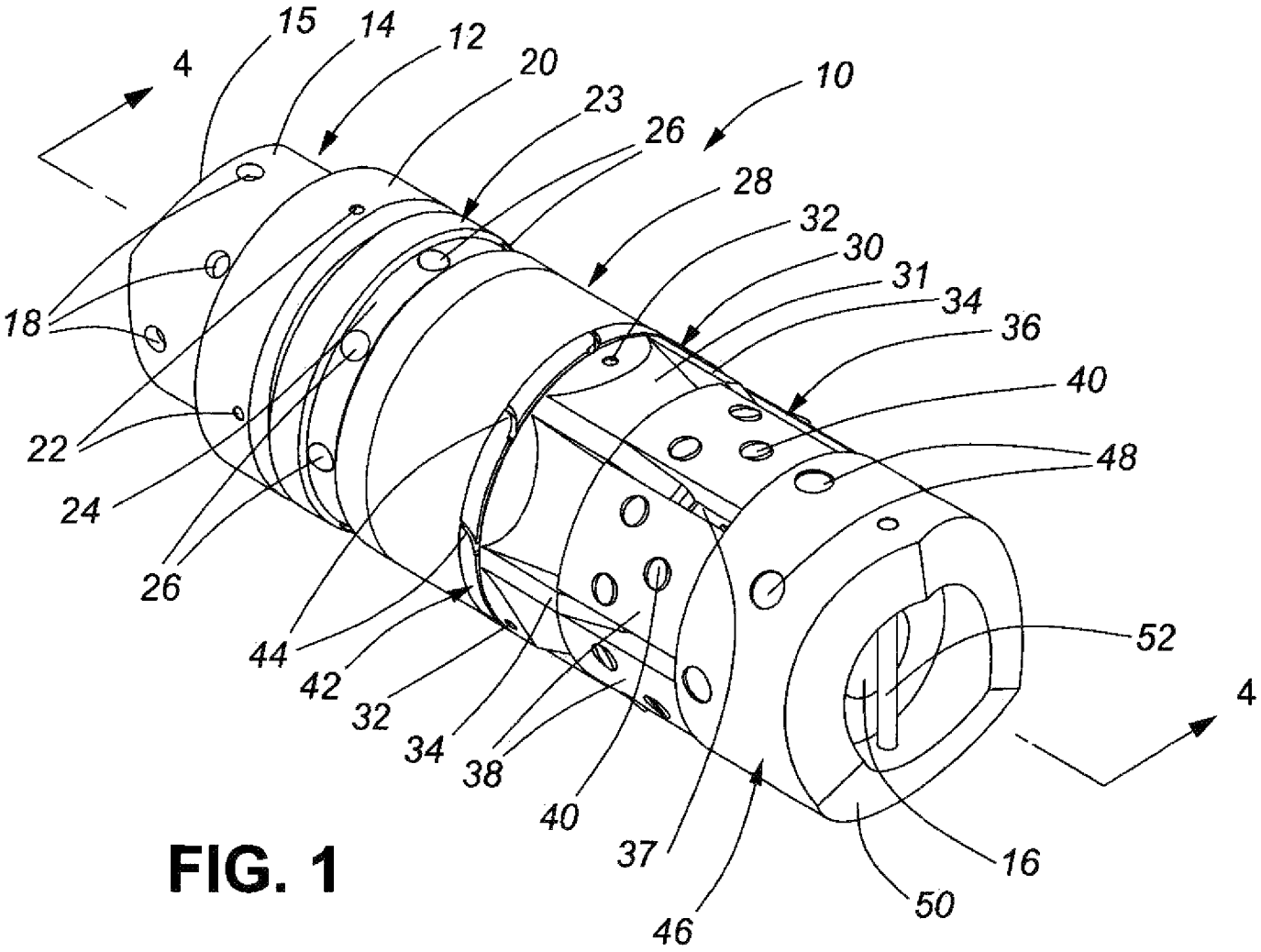
FIG. 1 is a perspective view of an embodiment of a composite frac plug in accordance with the invention, shown in a run-in condition used to pump the composite frac plug into a cased wellbore.

10*a* is a perspective view of another embodiment of a slip assembly for the composite frac plug shown in FIG. 1; and

10*b* is a perspective view of yet another embodiment of a slip assembly for the composite frac plug shown in FIG. 1.

DETAILED DESCRIPTION OF THE PREFERRED EMBODIMENTS

The invention provides a novel composite frac plug with a single slip assembly downhole of a main sealing element and an elastomeric gripper assembly up-hole of the main sealing element. Inserts in the elastomeric gripper assembly bite and grip a well casing to keep the main sealing element in a set condition after an initial set of the composite frac plug. The inserts may be ceramic inserts or hardened metal wickers. The inserts may be set directly in the elastomeric gripper assembly or set in composite slip bodies that are bonded within the elastomeric gripper assembly. The single slip assembly with the elastomeric gripper assembly make the composite frac plug appreciably shorter and lighter than known composite frac plugs with two sets of slips. The composite frac plug in accordance with the invention is therefore less expensive to build and more quickly milled out of a completed wellbore, reducing well completion time and expense.

PARTS LIST

| Part No. | Part Description |
|---|---|
| 10 | Composite frac plug |
| 12 | Composite mandrel |
| 14 | Composite mandrel hub |
| 15 | Composite mandrel hub sculpted end |
| 16 | Composite mandrel central passage |
| 18 | Shear screw bores |
| 20 | Gauge load ring |
| 22 | Gauge load ring preset retainer pins |
| 22a | Gauge load ring preset retainer pin stubs |
| 23 | Elastomeric gripper assembly with ceramic inserts |
| 23a | Elastomeric gripper assembly with hardened metal wickers |
| 23b | Elastomeric gripper assembly with metal wickers in slip body |
| 23c | Elastomeric gripper assembly with ceramic inserts in slip body |
| 24 | Elastomeric gripper assembly insert groove |
| 25 | Elastomeric gripper assembly stress relief groove |
| 26 | Ceramic gripper inserts |
| 26a | Hardened metal wickers |
| 27 | Elastomeric gripper assembly chamfered edge |
| 28 | Main sealing element |
| 29 | Composite slip body for hardened metal wickers |
| 29a | Composite slip body for ceramic inserts |

-continued

| Part No. | Part Description |
|---|---|
| 30 | Slip hub |
| 31 | Slip cone |
| 32 | Slip hub preset retainer pins |
| 32a | Slip hub preset retainer pin stubs |
| 34 | Slip cone guide ribs |
| 36 | Slip assembly with integral shear connectors |
| 36a | Slip assembly with composite band shear connectors |
| 36b | Slip assembly with metallic band shear connectors |
| 37 | Slip shear connectors |
| 38 | Composite slips |
| 39 | Hardened metal slips |
| 40 | Ceramic slip inserts |
| 41a-41b | Composite bands |
| 42 | Slip hub extrusion limiter |
| 43a-43b | Metallic bands |
| 44 | Slip hub extrusion limiter slots |
| 45 | Hardened metal slip wickers |
| 46 | Lower end sub |
| 47a, 47b | Composite band grooves |
| 48 | Lower end sub retainer pins |
| 49a, 49b | Metallic band grooves |
| 50 | Lower end sub sculpted end |
| 52 | Flow-back pin |
| 54 | Pump down fluid pressure |
| 56 | Frac fluid pressure |
| 58 | Frac ball |
| 60 | Well casing |

FIG. 1 is a perspective view of one embodiment of the composite frac plug 10 in accordance with the invention, shown in a run-in condition used to pump the composite frac plug 10 into a cased wellbore in a manner well known in the art. The composite frac plug 10 includes a composite mandrel 12 with an integral composite mandrel hub 14 on an up-hole end thereof. The composite mandrel hub 14 has a sculpted end 15, the purpose of which will be explained in more detail below. The composite mandrel 12 also has a central passage 16, best seen in FIGS. 4-6. Shear screw bores 18 in the composite mandrel hub 14 receive shear screws (not shown) that connect the composite frac plug 10 to a frac plug setting sleeve (not shown) that is in turn connected to a surface-located wireline setting tool (a Baker style size 20, for example, not shown) used to set the composite frac plug 10 in a manner well known in the art, which be explained below in more detail with reference to FIGS. 2 and 5.

A gauge load ring 20 downhole of the composite mandrel hub 14 is connected to the composite mandrel 12 by gauge load ring preset retainer pins 22. The gauge load ring preset retainer pins 22 secure the gauge load ring 20 in the run-in position shown in FIG. 1 until the composite frac plug 10 is pumped down to a desired location in a wellbore. The gauge load ring preset retainer pins 22 shear when the composite frac plug 10 is shifted from the run-in condition to the set condition, as will be explained below with reference to FIGS. 2 and 5. Downhole of the gauge load ring 20 is an elastomeric gripper assembly 23 with a circumferential gripper assembly insert groove 24. Circumferentially distributed in the elastomeric gripper assembly insert groove 24 are a plurality of elastomeric gripper assembly inserts 26 designed to bite and grip the casing when the composite frac plug 10 is moved to the set condition shown in FIGS. 5 and 6. In one embodiment, the elastomeric gripper assembly inserts 26 are made of a ceramic material commonly used for composite slip inserts, though other embodiments are equally effective as will be described below with reference to FIGS. 7*c*-7*h*. In the run-in condition shown FIG. 1, the elastomeric gripper assembly inserts 26 are recessed within the elastomeric gripper assembly insert groove 24 and do not contact a casing 60 of a wellbore, as shown in FIG. 3.

Adjacent a downhole side of the elastomeric gripper assembly 23 is an elastomeric main sealing element 28. The main sealing element 28 provides a high pressure>seal against the casing 60 when the composite frac plug 10 is in a set condition (see FIGS. 5 and 6). Adjacent a downhole side of the main sealing element 28 is a slip hub 30. The slip hub 30 is secured to the composite mandrel 12 by slip hub preset retainer pins 32, which shear when the composite frac plug 10 is shifted from the run-in condition to the set condition leaving slip hub preset retainer pin stubs 32*a* (see FIGS. 5 and 6), as will be explained below with reference to FIGS. 2 and 5, The slip hub 30 provides a slip cone 31 for a slip assembly 36 that in one embodiment is a frangible slip assembly that includes six composite slips 38 that are bound together by a binding while the composite frac plug 10 is in the run-in condition. In this embodiment, the binding is slip shear connectors 37 (better seen in FIG. 9*a*) that interconnect the respective composite slips 38. Other embodiments of the slip assembly 36 will be explained below with reference to FIGS. 10*a* and 10*b* in which the slips are bound together on the composite mandrel by a binding such as composite bands or metallic bands. In one embodiment each composite slip 38 includes three slip inserts 40. In one embodiment the slip inserts 40 are ceramic cylinders well known in the art, though they may also be hardened metal wickers, cast iron or any other suitable hardened metal, (see FIG. 10*b*), or the like. An up-hole end of the slip hub 30 includes a slip hub extrusion limiter 42 designed to limit extrusion of the main sealing element 28 when it is under the load of extreme fracturing fluid pressures. In one embodiment, the slip hub extrusion limiter 42 includes a plurality of curved-cut slots 44. The curved-cut slots 44 provide an elongated elastomer travel path to inhibit the extrusion of the main, sealing element 28. In one embodiment, the curved-cut slots 44 are partially cut through the slip hub extrusion limiter 42, so the slip hub extrusion limiter 42 cannot expand until the composite frac plug 10 is forced to the set condition which causes intended ruptures at each of the curved-cut slots 44. In one embodiment, the slip cone 31 also includes six slip cone guide ribs 34 that guide the respective composite slips 38 to a set position shown in FIGS. 2-6. The slip cone guide ribs 34 also shear the respective slip shear connectors 37 when the frangible slip assembly 36 is moved from the run-in to the set condition. The slip cone guide ribs 34 are optional and not required if the slip assembly is bound together using the bands described below with reference to FIGS. 8*a* and 8*b*.

Adjacent a lower end of the slip assembly 36 is a lower end sub 46. The lower end sub 46 is secured to the lower end of the composite mandrel 12 by lower end sub retainer pins 48 arranged in two staggered rows. The lower end sub 46 has a sculpted end 50 designed to mate with and engage the composite mandrel hub sculpted end 15. When the composite frac plug 10 is being drilled out after a well bore is completed, the lower end sub 46 is pushed ahead of the drill bit after the slips are drilled away because there is nothing to stop it from turning with the drill bit until it is pushed downhole to the next composite frac plug 10. When the lower end sub 46 contacts the next composite frac plug 10 the sculpted end 50 engages the sculpted end 15 and the lower end sub 46 stops rotating with the drill bit and is drilled away, in a manner well understood in the art. The mating shapes of the respective sculpted ends 15, 50 is a matter of design choice. A central passage in the lower end sub 46 is spanned by a flow-back pin 52, which prevents a frac ball 58 (see FIG. 6) from a downhole composite frac plug 10 from blocking the central passage 16 of the composite mandrel 12 during "flow-back" of well stimulation fluids after fracking of the wellbore is complete.

Figure 2:
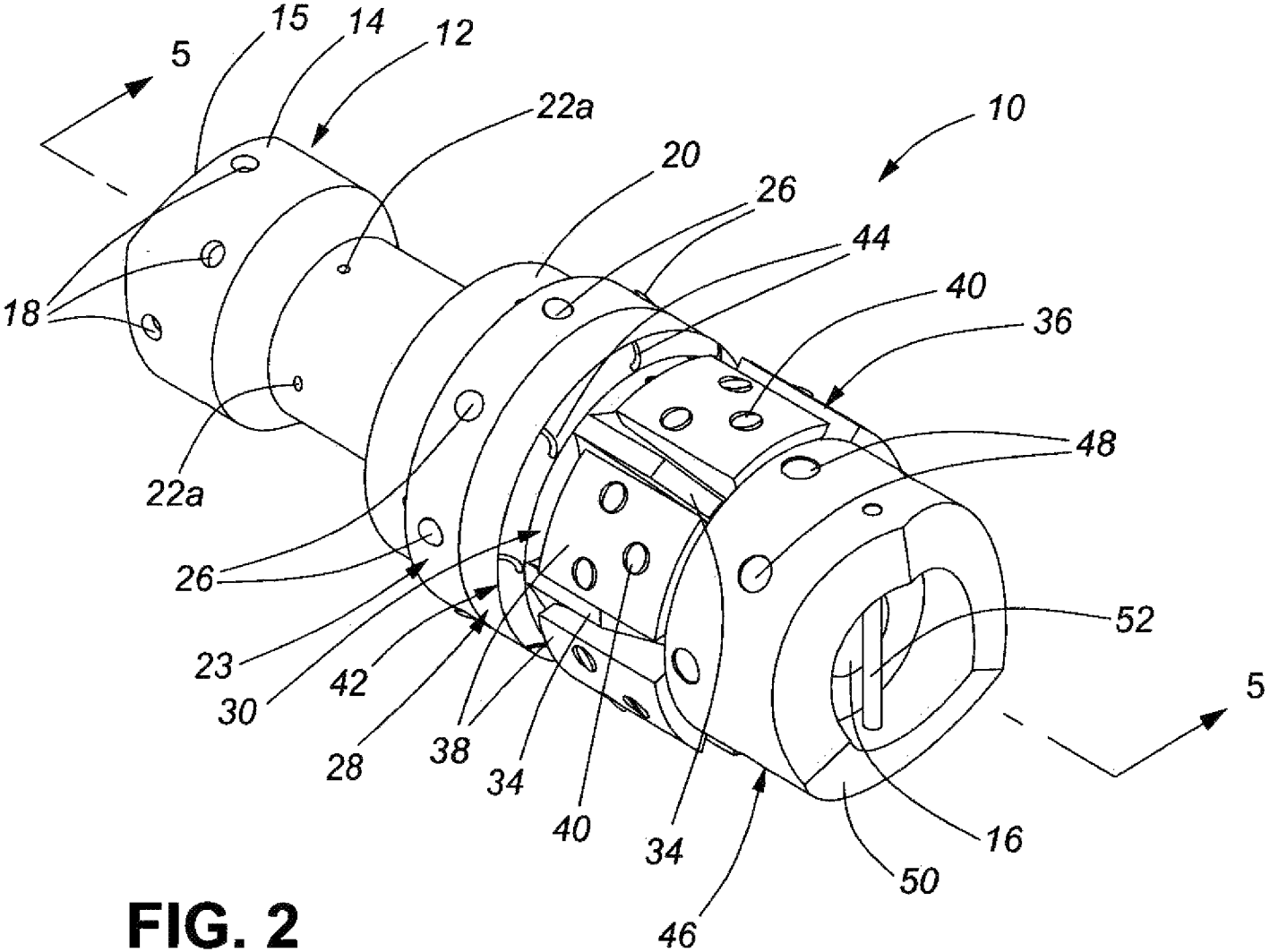
FIG. 2 is a perspective view of the composite frac plug shown in FIG. 1, in an initial-set condition to which it is shifted after it has been pumped to a desired location in the cased wellbore.
Figure 3:
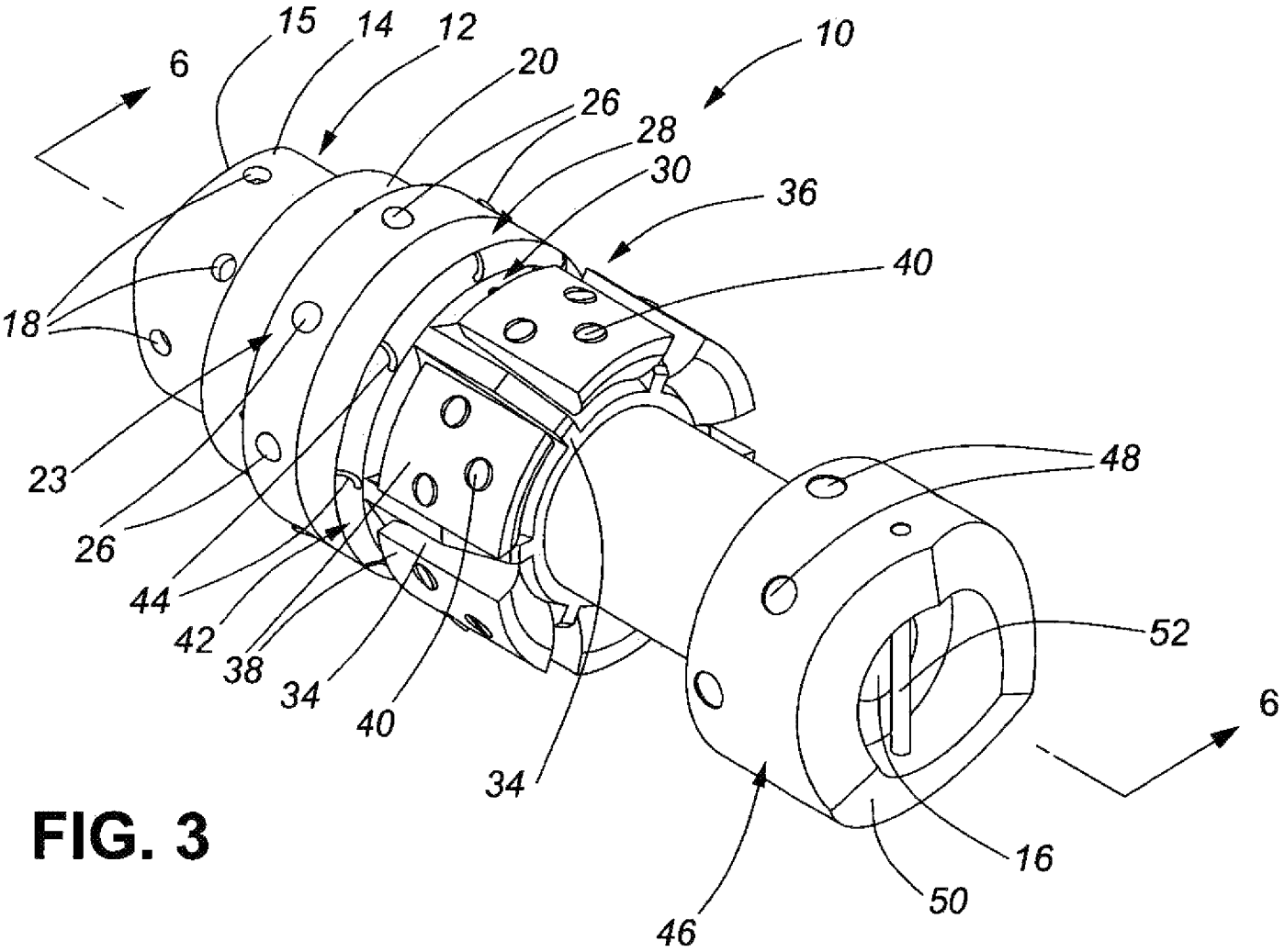
FIG. 3 is a perspective view of the composite frac plug shown in FIG. 1, in a final-set condition after frac fluid has been pumped into the cased wellbore subsequent to the initial set shown in FIG. 2.
Figure 4:
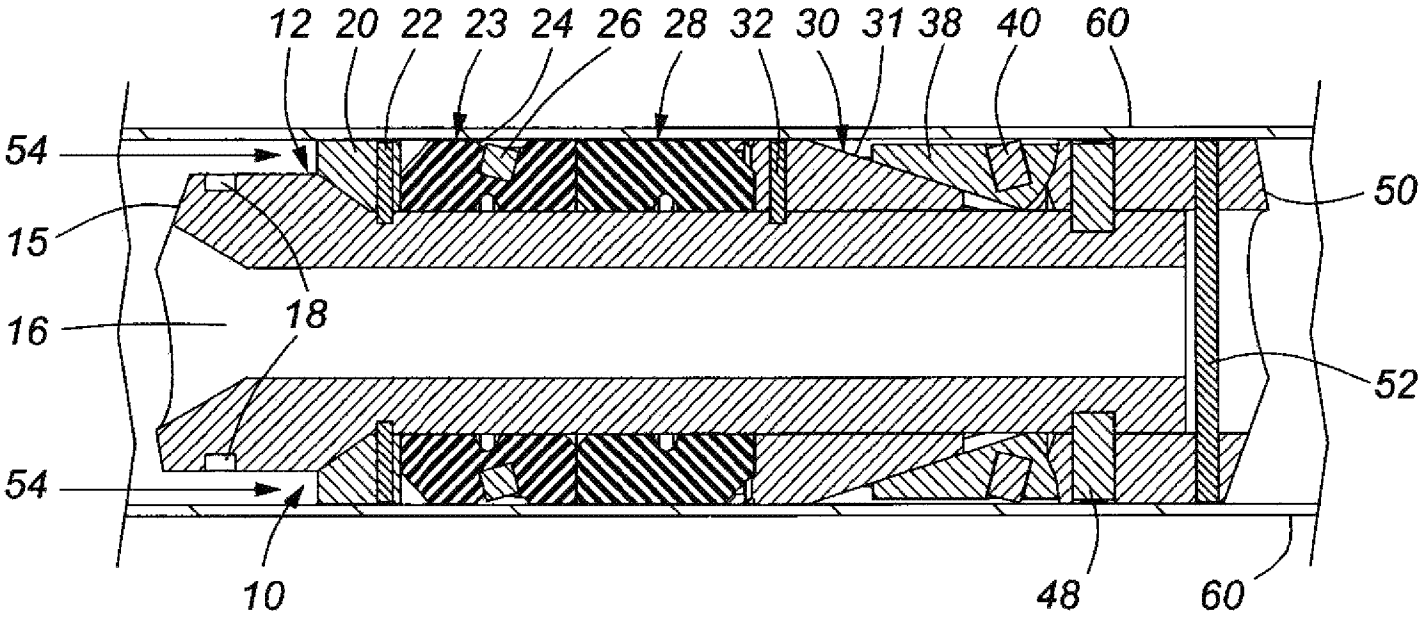
FIG. 4 is a cross-sectional view of the composite frac plug in the run-in condition shown in FIG. 1.

FIG. 2 is a perspective view of the composite frac plug 10 shown in FIG. 1 in an initial-set condition, to which it is shifted after the composite frac plug 10 has been pumped down to a desired location in a cased wellbore using pumped fluid pressure 54 (see FIG. 4). The initial-set condition is achieved by pulling up on the wireline (not shown) connected by the shear screws (not shown) driven into the shear screw bores 18 against pump-down fluid pressure 54 until the shear screws have sheared and the wireline is parted from the composite frac plug 10. The fluid pressure 54 in the wellbore resists up-hole movement of the composite frac plug 10 and the fluid pressure 54 on the gauge load ring 20 inhibits movement of the gauge load ring 20 while the composite mandrel 12 is pulled up-hole by the wireline. As the composite mandrel 12 is pulled up-hole, the gauge load ring preset retainer pins 22 shear, leaving gauge load ring preset retainer pin stubs 22*a*, and the gauge load ring 20 compresses the elastomeric gripper assembly 23, which forces the elastomeric gripper assembly inserts 26 into biting contact with the well casing 60 (see FIG. 4). The main sealing element 28 is also compressed into sealing contact with the casing 60, and the slip hub 30 is forced downwardly over the mandrel, which shears the slip hub preset retainer pins 32 (see FIG. 1), leaving slip hub retainer pin stubs 32*a* (see FIGS. 5 and 6), and forces the slip assembly 36 onto the slip cone 31. As the slip assembly 36 rides up on the slip cone 31, the slip cone guide ribs 34 shear the slip shear connectors 37 and the composite slips 38 are pushed up the slip cone 31 by the lower end sub 46 until the slip inserts 40 bite the casing 60. Meanwhile the compression of the main sealing element 28 expands the extrusion limiter 42 to inhibit extrusion of the main sealing element. In the initial set condition, the inserts 26 of the elastomeric gripper assembly 23 bite and grip the casing 60 to hold the main sealing element in compression, as shown in FIG. 5, until frac fluid is pumped down the wellbore.

FIG. 3 is a perspective view of the composite frac plug 10 shown in FIG. 1, in a final-set condition, after frac fluid has been pumped into the cased wellbore subsequent to the initial set shown in FIG. 2. In the final set condition, the composite mandrel 12 has been forced downhole until the composite mandrel hub 14 rests against the load gauge ring 20, as best seen in FIG. 6.

FIG. 4 is a cross-sectional view of the composite frac plug 10 in the run-in condition shown in FIG. 1. As seen, so long as the composite frac plug 10 is free to move down the casing 60 with pumped fluid pressure 54, the gauge load ring preset retainer pins 22 and the slip hub preset retainer pins 32 keep the elastomeric gripper assembly 23, the main sealing element 28 and the composite slips 36 in a relaxed and unset condition. The composite frac plug 10 is pumped downhole using a frac ball 58 (see FIG. 6) that blocks the central passage 16 to force the composite frac plug 10 downhole in response to the pumped fluid pressure 54.

Figure 5:
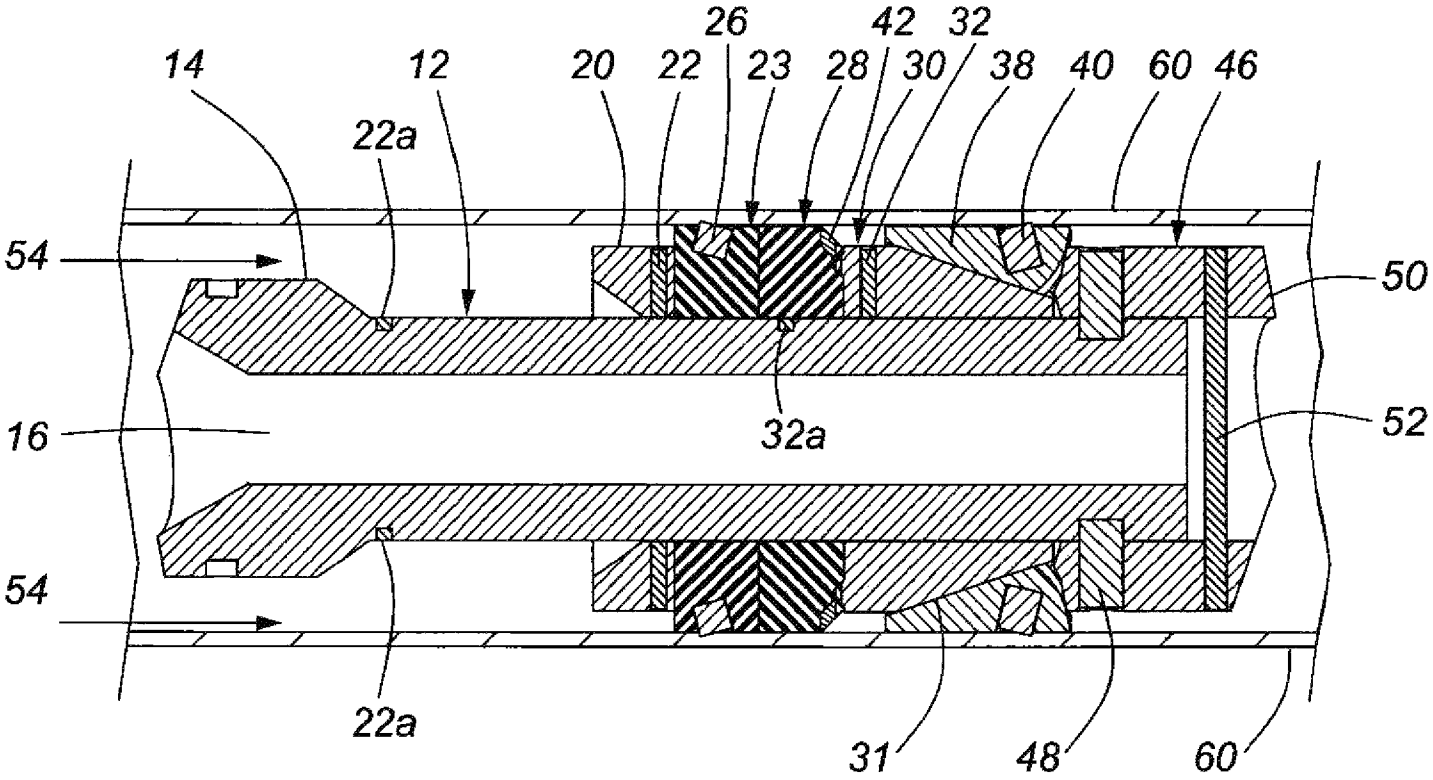
FIG. 5 is a cross-sectional view of the composite frac plug in the initial-set condition shown in FIG. 2.

FIG. 5 is a cross-sectional view of the composite frac plug 10 in the initial-set condition shown in FIG. 2. The composite mandrel 12 has been pulled up-hole using, for example, the wireline described above, and the gripper inserts 26 and slip inserts 40 bite and grip the casing to hold the main sealing element 28 in fluid-tight contact with the casing 60.

Figure 6:
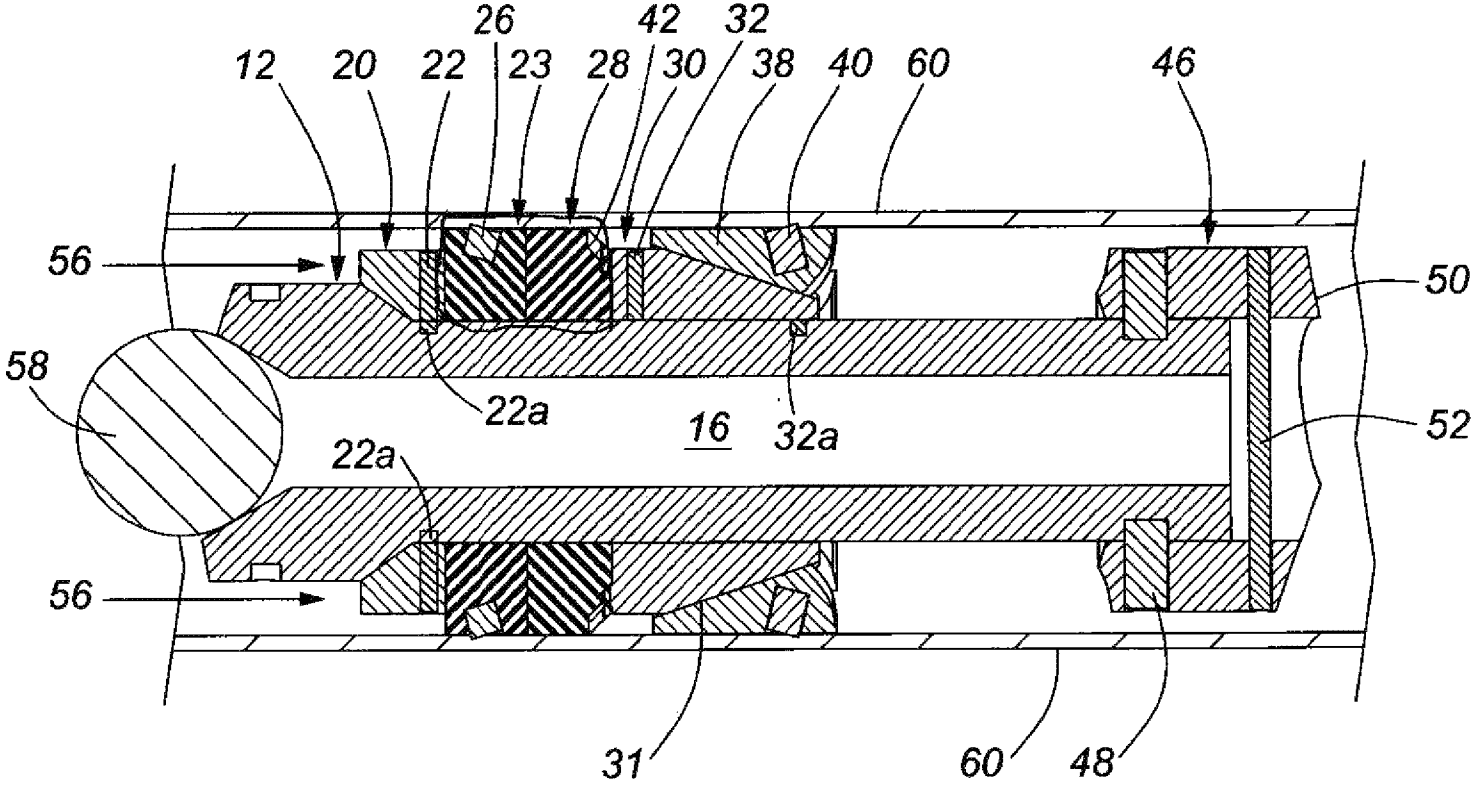
FIG. 6 is a cross-sectional view of the composite frac plug in the final-set condition shown in FIG. 3.

FIG. 6 is a cross-sectional view of the composite frac plug 10 in the final-set condition shown in FIG. 3. In the final set condition, the frac ball 58 dropped into the well bore and pumped down with the composite frac plug 10 is obstructing the central passage 16 of the composite mandrel hub 14. When frac fluid pressure 56 builds in the wellbore, it forces the composite mandrel 12 downhole against the gauge load ring 20. Thereafter, the compressive load of the frac fluid pressure 56 is carried by the slips of the slip assembly 36, in this example, the composite slips 38.

Figure 7B:
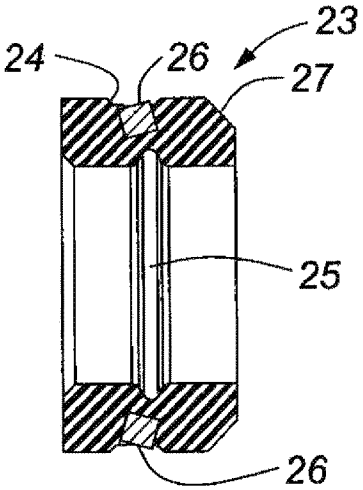
FIG. 7*b* is a cross-sectional view of the elastomeric gripper assembly shown in FIG. 7*a;*
Figure 7D:
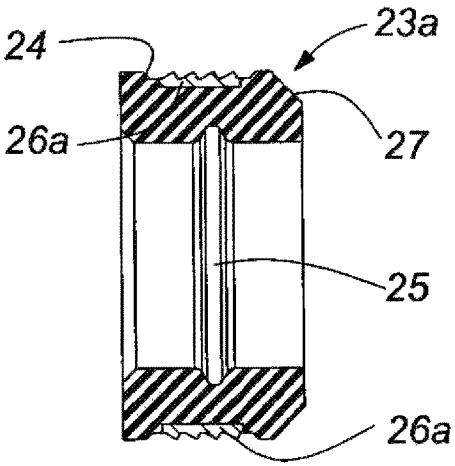
FIG. 7*d* is a cross-sectional view of the elastomeric gripper assembly shown in FIG. 7*c;*
Figure 7A:
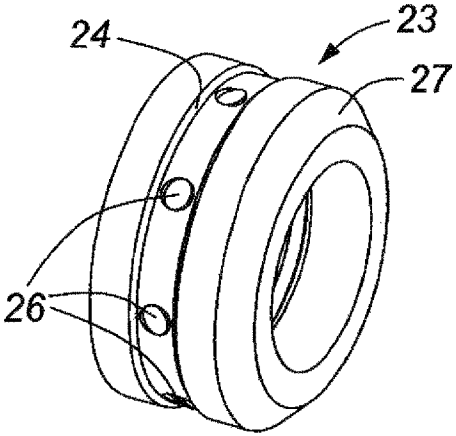
FIG. 7*a* is a perspective view of an elastomeric gripper assembly of the composite frac plug shown in FIG. 1.

FIG. 7*a* is a perspective view of the elastomeric gripper assembly 23 of the composite frac plug 10 shown in FIG. 1, and FIG. 7*b* is a cross-sectional view of the elastomeric gripper assembly 23 shown in FIG. 7*a*. All of the features of the elastomeric gripper assembly 23 have been described above, except a an elastomeric gripper assembly chamfered edge 27 which promotes deformation of the elastomeric gripper assembly 23 to force the gripper inserts 26 into biting contact with the casing 60, and a stress relief groove 25 which relieves component stress as the elastomeric gripper assembly 23 is compressed into the initial set condition shown in FIGS. 2 and 5.

Figure 7C:
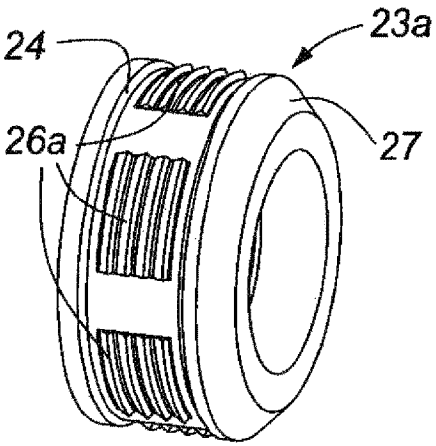
FIG. 7*c* is a perspective view of another embodiment of an elastomeric gripper assembly of the composite frac plug shown in FIG. 1.

7*c* is a perspective view of another embodiment of an elastomeric gripper assembly 23*a* of the composite frac plug 10 shown in FIG. 1, and FIG. 7*d* is a cross-sectional view of the elastomeric gripper assembly shown in FIG. 7*c*. In this embodiment the elastomeric gripper assembly 23*a* has a plurality of hardened metal wickers 26*a*, well known in the art, that bite and grip the casing 60. The hardened metal wickers 26*a* are respectively shaped to match the radius of the elastomeric gripper assembly insert groove 24 and incorporated into the elastomeric gripper assembly 23*a* flush with the outer surface of the elastomeric gripper assembly insert groove 24.

Figure 7E:
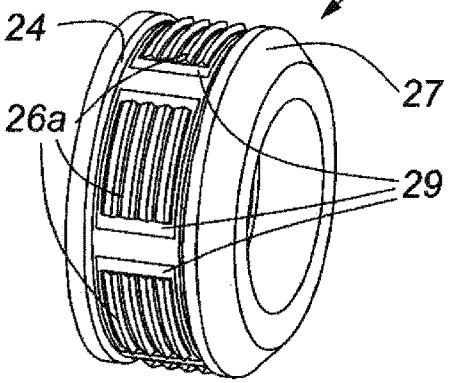
FIG. 7*e* is a perspective view of yet another embodiment of an elastomeric gripper assembly of the composite frac plug shown in FIG. 1.
Figure 7F:
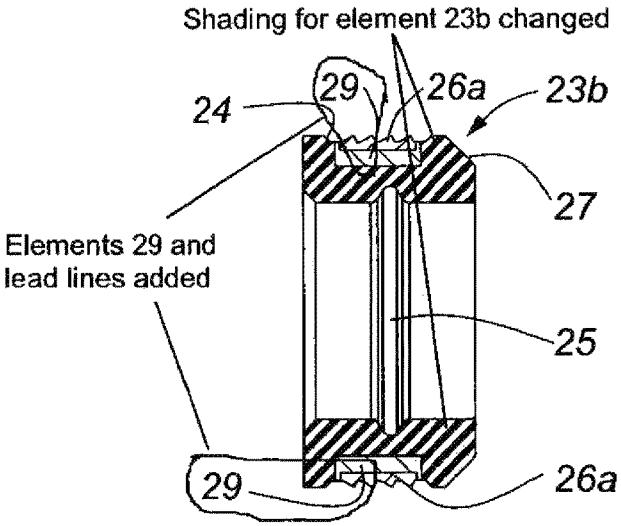
FIG. 7*f* is a cross-sectional view of the elastomeric gripper assembly shown in FIG. 7*e;*

FIG. 7*e* is a perspective view of yet another embodiment of an elastomeric gripper assembly 23*b* of the composite frac plug 10 shown in FIG. 1, and FIG. 7*f* is a cross-sectional view of the elastomeric gripper assembly 23*b* shown in FIG. 7*e*. In this embodiment the elastomeric gripper assembly 23*b* has a plurality of hardened metal wickers 26*a* that bite and grip the casing 60. The hardened metal wickers 26*a* are respectively shaped to match the radius of the elastomeric gripper assembly insert groove 24 and embedded in respective correspondingly-shaped rectangular composite slip bodies 29 that are in turn incorporated into the elastomeric gripper assembly 23*b* flush with the surface of the elastomeric gripper assembly insert groove 24.

Figure 7G:
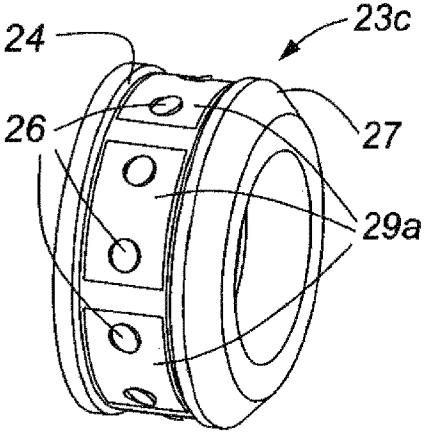
FIG. 7*g* is a perspective view of a further embodiment of the elastomeric gripper assembly of the composite frac plug shown in FIG. 1.
Figure 7H:
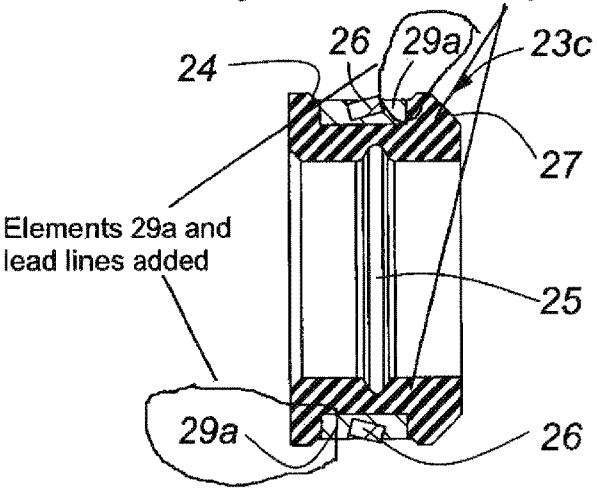
FIG. 7*h* is a cross-sectional view of the elastomeric gripper assembly shown in FIG. 7*g;*

FIG. 7*g* is a perspective view of a further embodiment of an elastomeric gripper assembly 23*c* of the composite frac plug 10 shown in FIG. 1, and FIG. 7*h* is a cross-sectional view of the elastomeric gripper assembly 23*c* shown in FIG. 7*g*. In this embodiment the elastomeric gripper assembly 23*c* has a plurality of ceramic inserts 26 that bite and grip the casing 60. The ceramic inserts 26 are embedded in respective rectangular composite slip bodies 29*a* that are in turn incorporated into the elastomeric gripper assembly 23*c* flush with the surface of the elastomeric gripper assembly insert groove 24.

Figure 8B:
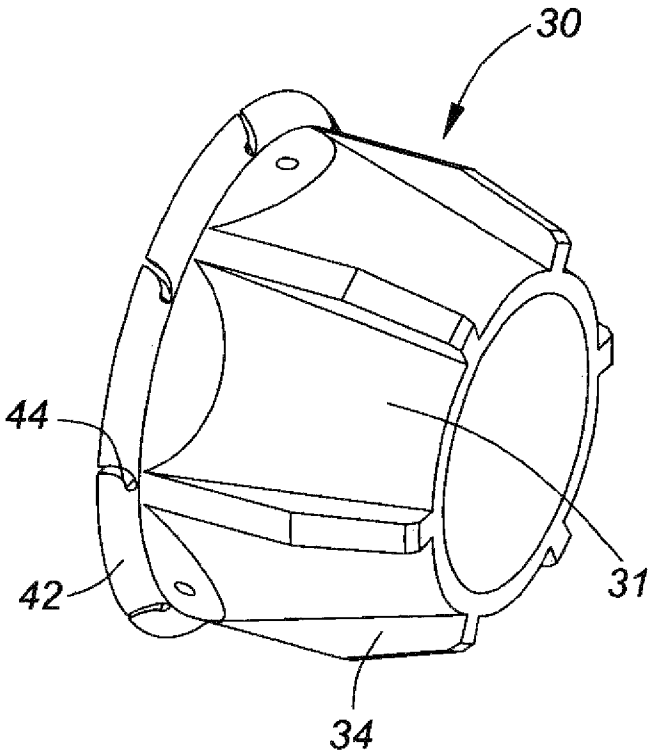
FIG. 8*b* is a perspective view of the slip hub with the extrusion limiter when the composite frac plug is in the final-set condition shown in FIG. 3.
Figure 8A:
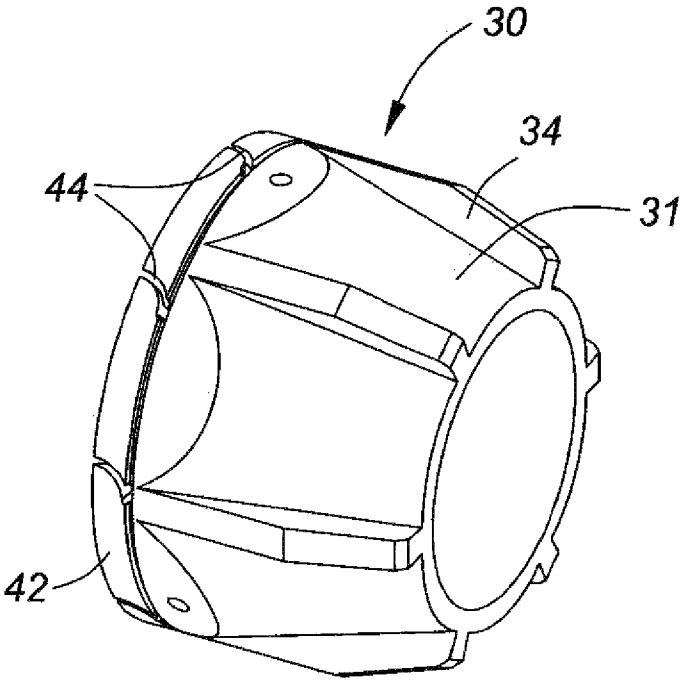
FIG. 8*a* is a perspective view of a slip hub with an extrusion limiter of the composite frac plug shown in FIG. 1.

FIG. 8*a* is a perspective view of the slip hub 30 with the slip cone 31 and the extrusion limiter 42 of the composite frac plug 10 shown in FIG. 1, and FIG. 8*b* is a perspective view of the slip hub 30 with slip cone 31 and the extrusion limiter 42 when the composite frac plug 10 is in the initial-set condition shown in FIGS. 2 and 5 and the final-set condition shown in FIGS. 3 and 6. All of the features of the slip hub 30 have been described above with reference to FIGS. 1-6.

Figure 9B:
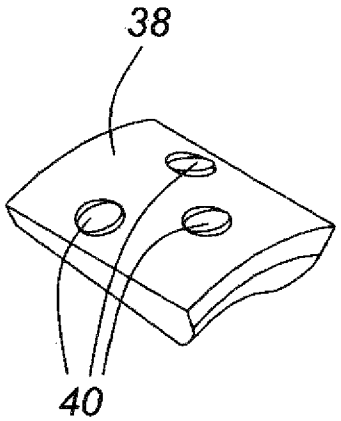
FIG. 9*b* is a perspective view of one of the slips of the slip assembly when the composite frac plug is in the initial set condition shown in FIG. 2 and the final-set condition shown in FIG. 3.
Figure 9A:
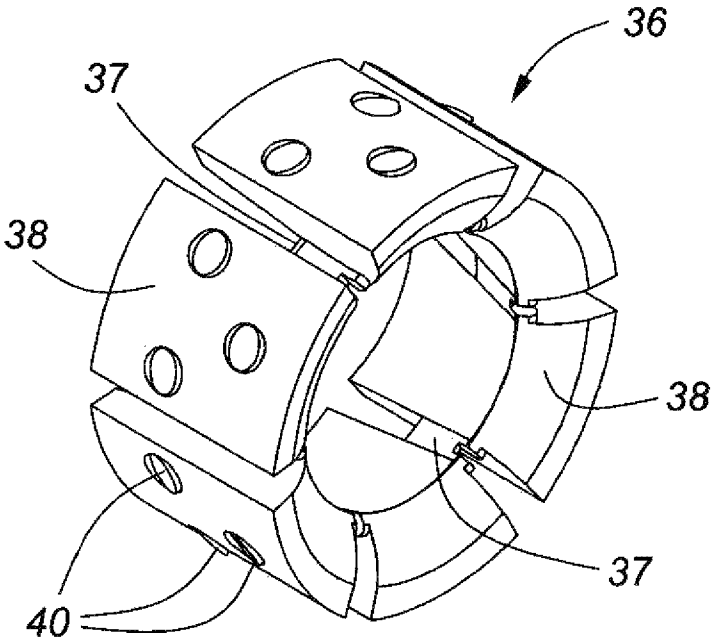
FIG. 9*a* is a perspective view of one embodiment of a slip assembly of the composite frac plug shown in FIG. 1.
Figure 10B:
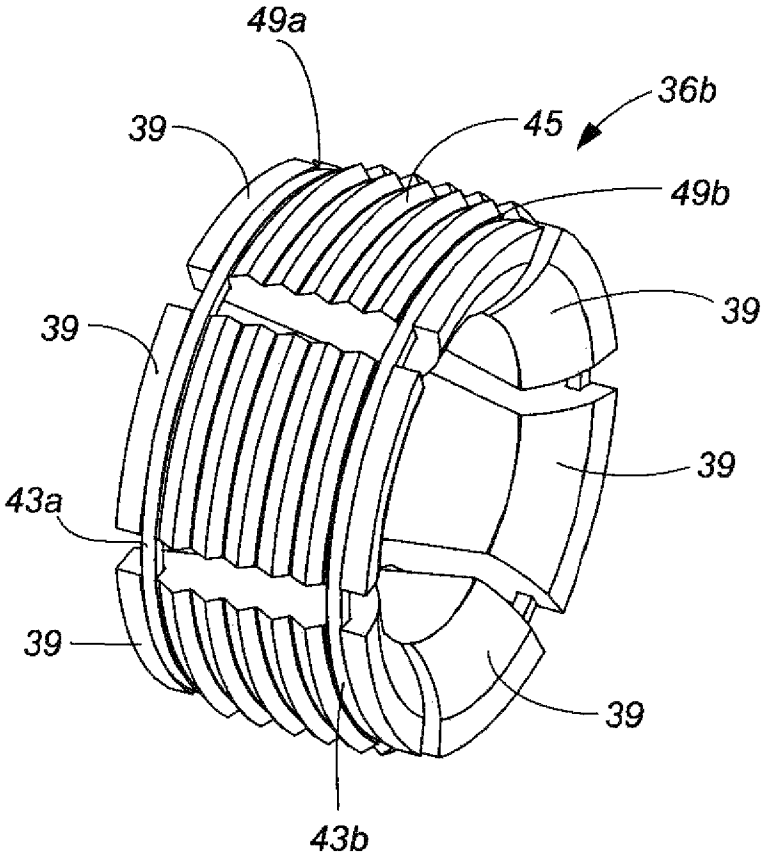

FIG. 9*a* is a perspective view of the slip assembly 36 of the composite frac plug 10 shown in FIG. 1, and FIG. 9*b* is a perspective view of one of the composite slips 38 of the slip assembly 36 when the composite frac plug 10 is in the initial-set and final-set conditions shown in FIGS. 2, 3, 5 and 6. All of the features of the slip assembly 36 have been described above with reference to FIGS. 1-6.

Figure 10A:
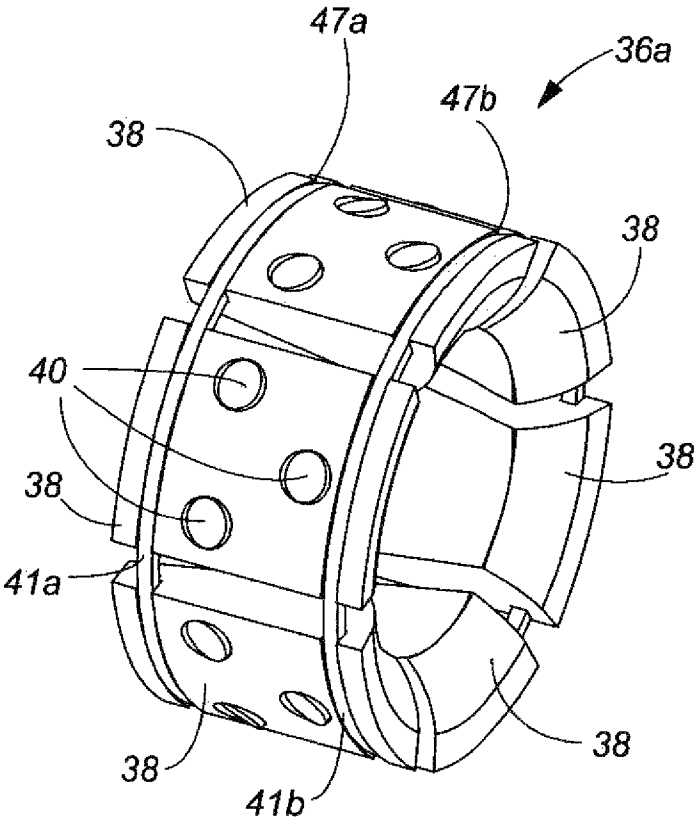

FIG. 10*a* is a perspective view of another embodiment of a slip assembly 36*a* for the composite frac plug shown in FIG. 1. The slip assembly 36*a* is similar to slip assembly 36 shown in FIGS. 9*a* and 9*b*, except that the composite slips 38 with ceramic inserts 40 are bound together on the composite mandrel 12 in the run-in condition shown in FIGS. 1 and 3 by composite bands 41*a*, 41*b* lodged in respective radial composite band grooves 47*a*, 47*b* formed in each composite slip 38. The respective composite bands 41*a* 41*b* are sheared by tensile hoop stress when the composite frac plug 10 is shifted from the run-in condition to the initial set position, as explained above with reference to FIGS. 1-2 and 4-5. It should be noted that with this embodiment of the slip assembly 36*a*, the slip cone guide ribs 34 on the slip cone 31 shown in FIGS. 9*a* and 9*b* are optional, as explained above.

10*b* is a perspective view of yet another embodiment of a slip assembly 36*b* for the composite frac plug shown in FIG. 1. The slip assembly 36*b* is similar to slip assembly 36 shown in FIGS. 9*a* and 9*b*, except that the slips 39 are hardened metal, such as cast iron or any other hardened metal suitable for this application, with wickers 45, constructed in a manner known in the art. The slips 39 are bound together on the composite mandrel 12 in the run-in condition shown in FIGS. 1 and 3 by metallic bands 43*a*, 43*b* lodged in respective radial grooves 49*a*, 49*b* cast or machined into each composite slip 38. The respective composite bands 43*a*, 43*b* are sheared by tensile hoop stress when the frac plug 10 is shifted from the run-in condition to the initial set position, as explained above with reference to FIGS. 1-2 and 4-5. It should be noted that with this embodiment of the slip assembly 36*b*, the slip cone guide ribs 34 on the slip cone 31 shown in FIGS. 9*a* and 9*b* are optional, as explained above.

The explicit embodiments of the invention described above have been presented by way of example only. Other embodiments of the composite frac plug are readily constructed with minor alterations, as will be understood by those skilled in the art. The scope of the invention is therefore intended to be limited solely by the scope of the appended claims.

The explicit embodiments of the invention described above have been presented by way of example only. Other embodiments of the composite frac plug are readily constructed with minor alterations, as will be understood by those skilled in the art. The scope of the invention is therefore intended to be limited solely by the scope of the appended claims.

I claim:

1. A composite frac plug, comprising an elastomeric gripper assembly mounted to a composite mandrel having a central passage, the elastomeric gripper assembly having a circumferential insert groove in an outer periphery thereof with a plurality of circumferentially spaced-apart inserts in the insert groove which, in a run-in condition of the composite frac plug, are recessed within the circumferential insert groove of the elastomeric gripper assembly and do not contact a casing of a wellbore, and in a set condition of the composite frac plug respectively bite and grip the casing.

2. The composite frac plug as claimed in claim 1 wherein the inserts comprise ceramic gripper inserts.

3. The composite frac plug as claimed in claim 2 wherein the ceramic gripper inserts are embedded in composite slip bodies that are flush with a surface of the circumferential insert, groove.

4. The composite frac plug as claimed in claim 1 wherein the inserts comprise hardened metal slips with wickers.

5. The composite frac plug as claimed in claim 4 wherein the hardened metal slips are embedded in composite slip bodies that are flush with a surface of the circumferential insert groove.

6. A composite frac plug, comprising:

a composite mandrel with a central passage, the composite mandrel further having an up-hole end and a downhole end with a mandrel hub on the up-hole end and an end sub securely affixed to the downhole end;

an elastomeric gripper assembly mounted to the mandrel, the elastomeric gripper assembly having a circumferential insert groove with a plurality of circumferentially spaced-apart inserts which, in a run-in condition of the composite frac plug, are recessed within the circumferential insert groove of the elastomeric gripper assembly and do not contact a casing of a wellbore, and in a set condition of the composite frac plug bite and grip the casing;

a main sealing element downhole of the elastomeric gripper assembly;

a slip hub having a slip cone downhole of the main sealing element; and a slip assembly downhole of the slip hub, the slip assembly comprising a plurality of slips adapted to slide up the slip cone to bite and grip the casing of the cased wellbore in the set condition.

7. The composite frac plug as claimed in claim 6 further comprising a gauge load ring adjacent an up-hole end of the elastomeric gripper assembly.

8. The composite frac plug as claimed in claim 7 wherein the gauge load ring is connected to the composite mandrel by preset retainer pins that shear as the composite frac plug is shifted from the run-in condition to the set condition.

9. The composite frac plug as claimed in claim 6 further comprising an extrusion limiter connected to an up-hole end of the slip hub, the extrusion limiter having a plurality of spaced-apart curved-cut slots to permit the extrusion limiter to expand as the composite frac plug is shifted from the run-in condition to the set condition.

10. The composite frac plug as claimed in claim 9 wherein the curved cut slots are only partially cut through the extrusion limiter so the slip hub extrusion limiter cannot expand until the composite frac plug is shifted to the set condition.

11. The composite frac plug as claimed in claim 6 wherein the slip hub is connected to the composite mandrel by preset retainer pins that shear as the composite frac plug is shifted from the run-in condition to the set condition.

12. The composite frac plug as claimed in claim 6 wherein the elastomeric gripper assembly further comprises a chamfered edge on an up-hole side thereof and a stress relief groove in an inner periphery thereof.

13. The composite frac plug as claimed in claim 6 wherein the slip assembly comprises a plurality of interconnected slips, the interconnected slips being bound together on the composite mandrel by a binding that, is sheared as the composite frac plug is shifted from the run-in condition to the set condition.

14. The composite frac plug as claimed in claim 6 wherein the inserts comprise ceramic gripper inserts.

15. The composite frac plug as claimed in claim 14 wherein the ceramic gripper inserts are embedded in composite slip bodies that are flush with a surface of the circumferential insert groove.

16. The composite frac plug as claimed in claim 6 wherein the inserts comprise hardened metal slips with wickers.

17. The composite frac plug as claimed in claim 16 wherein the hardened metal slips are embedded in composite slip bodies that are flush with a surface of the circumferential insert groove.

18. A composite frac plug, comprising:

a composite mandrel with a central passage, the composite mandrel further having an up-hole end and a downhole end, with a mandrel hub on the up-hole end and an end sub affixed to the downhole end;

a gauge load ring adjacent the mandrel hub and affixed to the composite mandrel by gauge load ring preset, retainer pins;

an elastomeric gripper assembly mounted to the mandrel, the elastomeric gripper assembly having a circumferential insert groove with a plurality of circumferentially spaced-apart inserts which, in a run-in condition of the composite frac plug, are recessed within the circumferential insert groove of the elastomeric gripper assembly and do not contact a casing of a wellbore, and in a set condition of the composite frac plug bite and grip the casing;

a main sealing element downhole of the elastomeric gripper assembly that provides a high pressure seal with the casing in the set condition;

a slip hub with a slip cone downhole of the main sealing element; and a slip assembly downhole of the slip hub, the slip assembly comprising a plurality of slips adapted to be pushed up the slip cone by the end sub and to bite and grip the casing of the cased wellbore in the set condition.

19. The composite frac plug as claimed in claim 18 wherein the inserts comprise one of ceramic grippers and hardened metal slips with wickers.

20. The composite frac plug as claimed in claim 19 wherein the inserts are embedded in composite slip bodies that are flush with a surface of the circumferential insert groove.

* * * * *